US006079158A

United States Patent [19]

Brodbeck

[11] Patent Number: 6,079,158

[45] Date of Patent: Jun. 27, 2000

[54] DOOR AND LATCH ASSEMBLY FOR A HOUSING

[75] Inventor: Robert M. Brodbeck, Littleton, Colo.

[73] Assignee: Claney Systems International, Inc., Denver, Colo.

[21] Appl. No.: 09/014,126

[22] Filed: Jan. 27, 1998

[51] Int. Cl.[7] ..... E05C 3/04

[52] U.S. Cl. ..... 49/394; 292/102; 292/241; 292/DIG. 38

[58] Field of Search ..... 49/394, 383, 391; 292/240, 241, 304, DIG. 38, 102, 203

[56] References Cited

U.S. PATENT DOCUMENTS

| | | | |
|---|---|---|---|
| 2,465,452 | 3/1949 | Helling | 292/241 |
| 4,896,905 | 1/1990 | Lehr et al. | 292/241 |
| 5,238,275 | 8/1993 | Fretto | 292/241 |
| 5,630,632 | 5/1997 | Swan | 292/240 |
| 5,653,485 | 8/1997 | Campbell | 292/241 |

*Primary Examiner*—Daniel P. Stodola
*Assistant Examiner*—Curtis A. Cohen

[57] ABSTRACT

The assembly includes an integral corner door and a latch assembly, the latch assembly including a user acuatable element, a dog-ear element, a cam receiving element and a door extension. The integral corner door has a hinging portion hingedly connected to a first surface of the housing and a latching portion perpendicular to the hinging portion connectable to a second surface of the housing. The user actuatable element has a user manipulative portion and a rotatable shaft affixed thereto. The user manipulative portion is positioned on the second surface of the housing. The shaft extends through an opening through the second surface. The dog-ear element of the latch assembly is securely affixed to the shaft. The dog-ear element has a first hooked end and a second end. The first hooked end forms a recess. The hooked end has a terminal cam portion. The second end includes a door disengaging portion. The cam receiving element of the latch assembly is located on the latching portion of the corner door for receiving the terminal cam portion of the dog-ear element when the shaft has been rotated sufficiently, thus securing the corner door in a latched position. The door extension of the latch assembly is located on the latching portion of the corner door. It is urged against by the door disengaging portion when the shaft has been sufficiently counter rotated, thus pushing the corner door open. The door extension rotates the dog-ear element away from the corner door when a user closes the door as preparatory to locking it, thereby obviating the need for the user to manually rotate the shaft in order to close the door and thus avoiding potential damage of the dog-ear element.

13 Claims, 3 Drawing Sheets

DOOR AND LATCH ASSEMBLY FOR A HOUSING

BACKGROUND OF THE INVENTION

1. Field of the Invention

The present invention relates to door and latch assemblies for various housings and more particularly to a door and latch assembly for housings which utilize corner doors.

2. Description of the Related Art

Various housings require corner doors for providing access to the interior of the housing. Such corner doors generally are hinged to a first surface of the housing, the door curves around forming a section of the corner of the housing, and then locks to the housing along a surface of the housing which is orthogonal to the first surface. Many of the housings utilized are formed of plastic. The locking mechanism typically involves reliance upon the characteristic of plastic to return to its original form after being bent. Such a locking mechanism is typically deficient when a shock is applied to the housing such as when the item is dropped.

Corner doors are prevalent with handheld electronic devices such as computer/printer devices for printing tickets or invoices. Such devices typically utilize removable PCMCIA memory cards. Use of a corner door allows access to a large area in the housing to pull the card out.

Such corner doors are also used very often for battery compartments for various electronic devices.

OBJECTS AND SUMMARY OF THE INVENTION

It is therefore a principal object of the present invention to provide efficient latching and opening of a corner door of a housing.

It is another object to provide an inexpensive latching mechanism which provides a secure latching and which is able to withstand a severe shock and remain latched.

It is yet another object to provide such a latching mechanism which does not require adjustment or re-positioning when the door is being closed, thereby obviating potential damage.

These and other objects are achieved by the present invention which is a door and latch assembly for a housing. In its broad aspects, the assembly includes an integral corner door and a latch assembly, the latch assembly including a user acuatable element, a dog-ear element, a cam receiving element and a door extension. The integral corner door has a hinging portion hingedly connected to a first surface of the housing and a latching portion perpendicular to the hinging portion connectable to a second surface of the housing. The user actuatable element has a user manipulative portion and a rotatable shaft affixed thereto. The user manipulative portion is positioned on the second surface of the housing. The shaft extends through an opening through the second surface. The dog-ear element of the latch assembly is securely affixed to the shaft. The dog-ear element has a first hooked end and a second end. The first hooked end forms a recess. The hooked end has a terminal cam portion. The second end includes a door disengaging portion. The cam receiving element of the latch assembly is located on the latching portion of the corner door for receiving the terminal cam portion of the dog-ear element when the shaft has been rotated sufficiently, thus securing the corner door in a latched position. The door extension of the latch assembly is located on the latching portion of the corner door. It is urged against by the door disengaging portion when the shaft has been sufficiently counter rotated, thus pushing the corner door open. The door extension rotates the dog-ear element away from the corner door when a user closes the door as preparatory to locking it, thereby obviating the need for the user to manually rotate the shaft in order to close the door and thus avoiding potential damage of the dog-ear element.

The present invention is particularly useful for applications with handheld electronic devices such as computer/printer devices for printing tickets or invoices. As noted above, such devices typically utilize removable PCMCIA memory cards which require access to a relatively large area in the housing in order to pull the card out. These devices typically therefore use corner doors. The present invention prevents potential damage to the latching mechanism when the user closes the door.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figure 1:
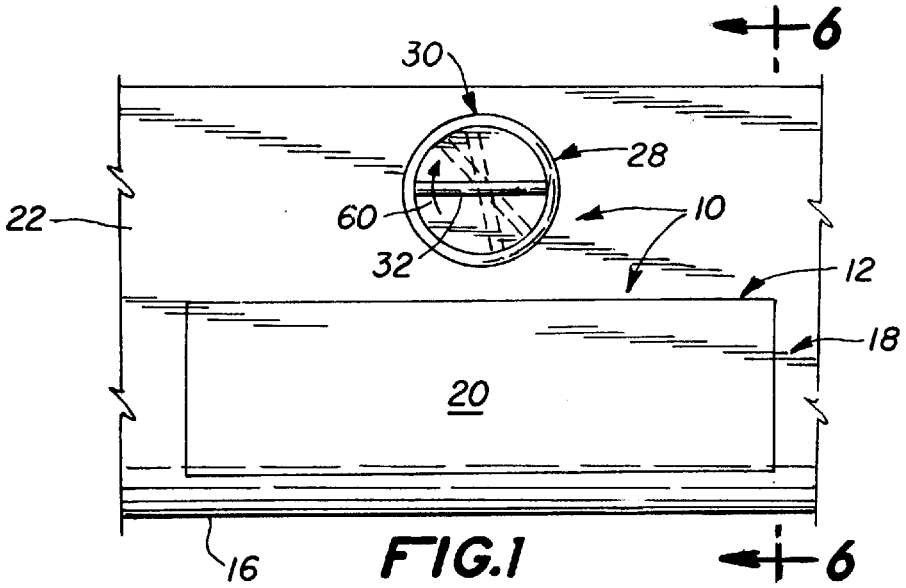
FIG. 1 is a front elevational view of a portion of a housing showing the corner door and the knob of the latch assembly of the present invention.
Figure 6:
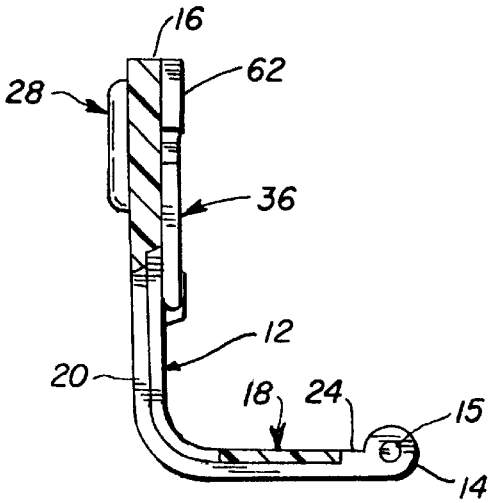
FIG. 6 is a view taken along Line 6—6 of FIG. 1.

Referring now to the drawings and the characters of reference marked thereon FIGS. 1 and 6 illustrate the self-positioning door and latch assembly, designated generally as 10, of the present invention, with the corner door, designated generally as 12, shown fully closed.

The corner door 12 is preferably a 1-piece (i.e. integrally formed) plastic door having a hinging portion 14 hingedly connected via pivot bar 15 to a first surface 16 (best seen in FIG. 2) of a housing, designated generally as 18. A latching portion 20 of the corner door 12 is perpendicular to the hinging portion 14 and is connectable to a second surface 22 of the housing when in the latched position.

Figure 2:
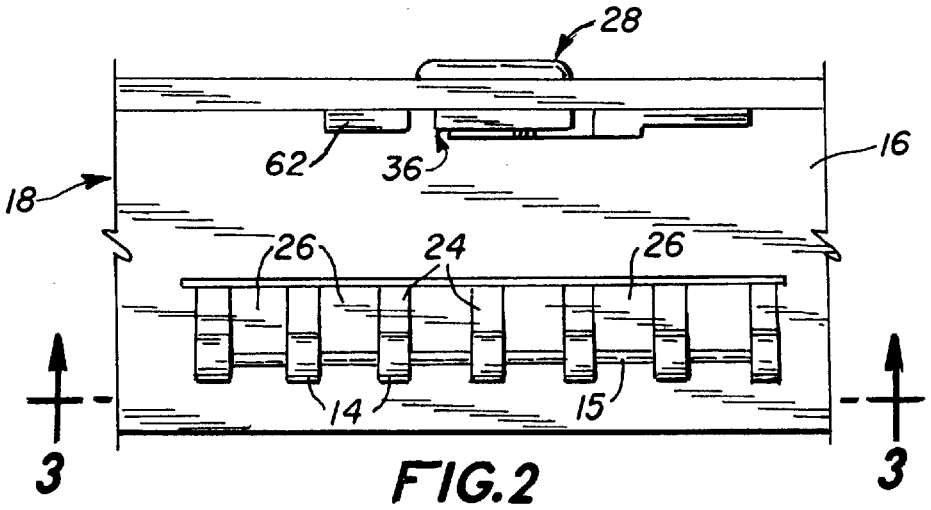
FIG. 2 is a top plan view of the inside of the housing showing a side view of the latch assembly of the present invention.

As can be seen in FIG. 2, the corner door 12 includes a plurality of extensions 24 which are connected at their respective ends by the pivot bar 15. The extensions 24 engage teeth 26 of the housing 18. The pivot bar 15 rests within grooves (not shown) of the teeth 26. Although this particular hinge has been illustrated and described in some detail, it is understood that various other suitable hinging mechanisms could be used.

Figure 3:
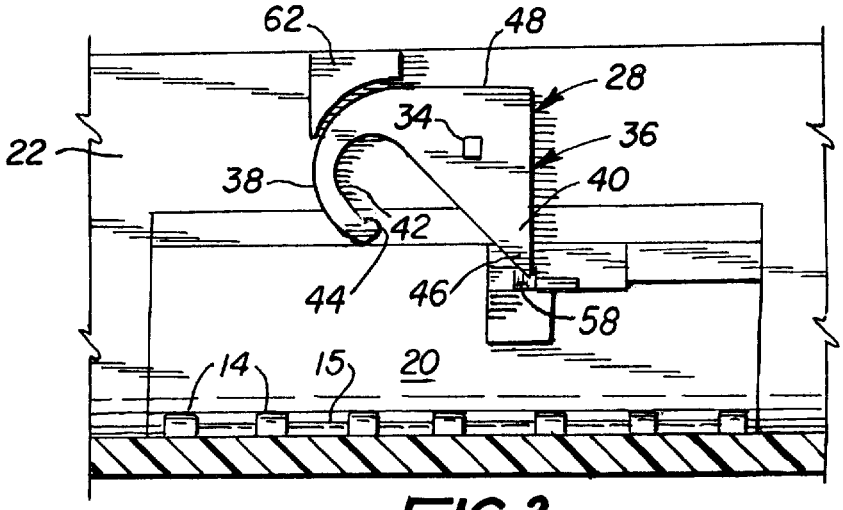
FIG. 3 is a view shown along Line 3—3 of FIG. 2, the door being slightly open, and the dog-ear element beginning to engage the door extension of the latch assembly.

Referring now to FIG. 1, in conjunction with FIG. 3, it can be seen that the latch assembly, designated generally as 28, includes a user actuatable element 30 having a user manipulative portion or knob 32 with a rotatable shaft 34 affixed thereto. The knob is positioned on the second surface 22 of the housing. The shaft 34 extends through an opening through that second surface 22.

The latch assembly 28 includes a dog-ear element 36 securely affixed to the shaft 34. The dog-ear element 36 has a first hooked end 38 and second end 40. The first hooked end 38 forms a recess 42. The hooked end 38 has a terminal cam portion 44. The second end 40 includes a door disengaging portion and a stop engaging portion 48.

Figure 10:
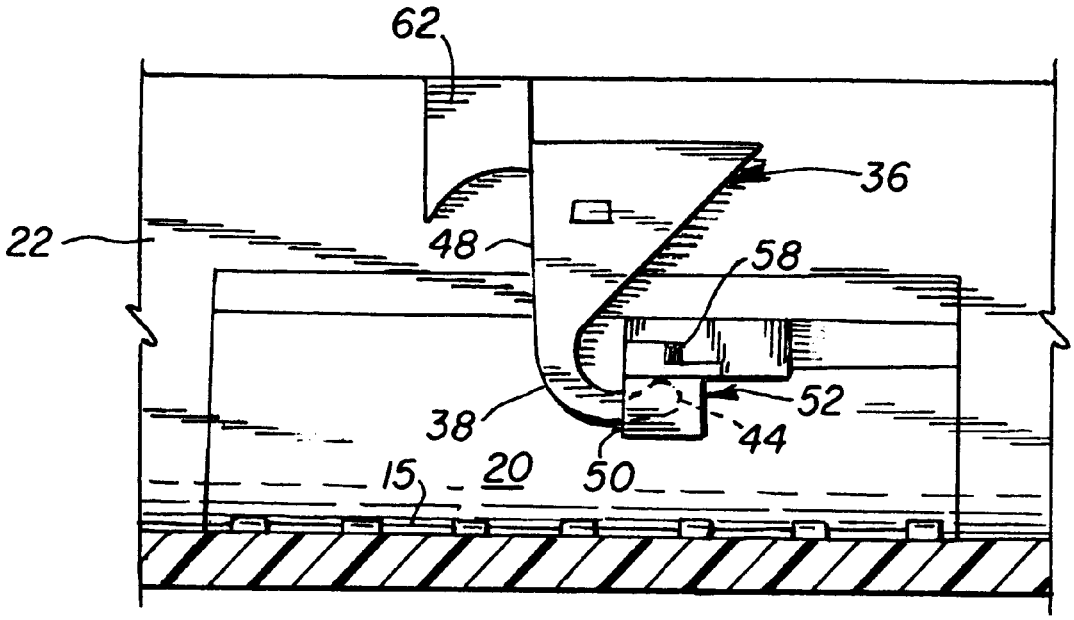
FIG. 10 is the same view as that in FIG. 3, but showing the latch assembly in a closed position.

As can be seen by reference to FIG. 10, a cam receiving element 50 is located on the latching portion 20 of the corner door 12. This cam receiving element 50 receives the terminal cam portion 44 of the dog-ear element 36 when the shaft 34 has been rotated sufficiently, thus securing the corner door 12 in a latched position. In the embodiment illustrated, the cam receiving element 50 is a portion of a door extension, designated generally as 52, which provides additional functions, as will be described below. The cam receiving element 50 could be manufactured as a distinct element from the door extension 52. The terminal cam portion 44 fits within an opening on the side of the cam receiving element 50.

Figure 5:
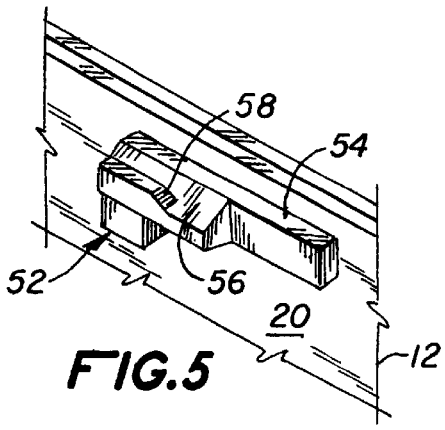
FIG. 5 is an enlarged view of a portion of the corner door showing the door extension in detail.

Referring now to FIG. 5, an enlarged view of the door extension 52 is shown. It is located on the latching portion 20 of the corner door 12. It includes a ledge surface 54, a relatively long sloped surface 56 depending from the ledge surface 54, and a relatively short sloped surface 58 depending from the relatively long sloped surface 56 and being sloped relative to both the relatively long sloped surface 56 and the latching portion 20.

Figure 9:
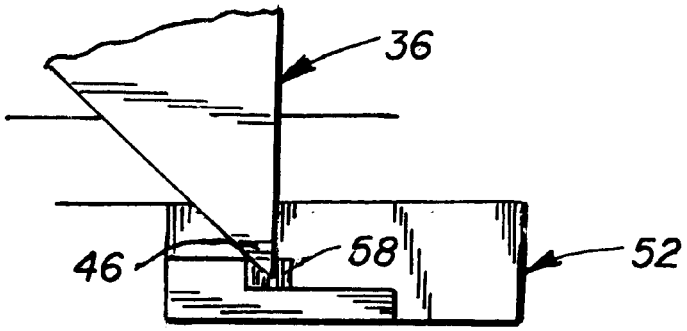
FIG. 9 is an enlarged view of a portion of FIG. 3.

Referring now to FIGS. 3 and 9, when the corner door 12 is being closed, the pointed door disengaging portion of the dog-ear element 36 is urged against the short sloped surface 58, providing rotation of the dog-ear element 36 as preparatory to locking the door. The short sloped surface 58 is preferably planer and at an angle in a range from about 40 to 50° from the plane of the latching portion 20 of the corner door 12. In this preferred embodiment it is about 45° from said plane. The force exerted on the dog-ear element 36 by the surface 58 actually causes the dog-ear element 36 to "pop" away from the door extension 52 in a rotating manner, thus avoiding potential damage to the element 36. The user then merely rotates the knob 30 in the direction of arrow 60 (see FIG. 1), a short distance, to the position shown in FIG. 10. As can be most clearly seen in FIG. 10, a stop 62 located on the housing 18 prevents over rotation of the user actuatable element 30 beyond the latched position.

Figure 4:
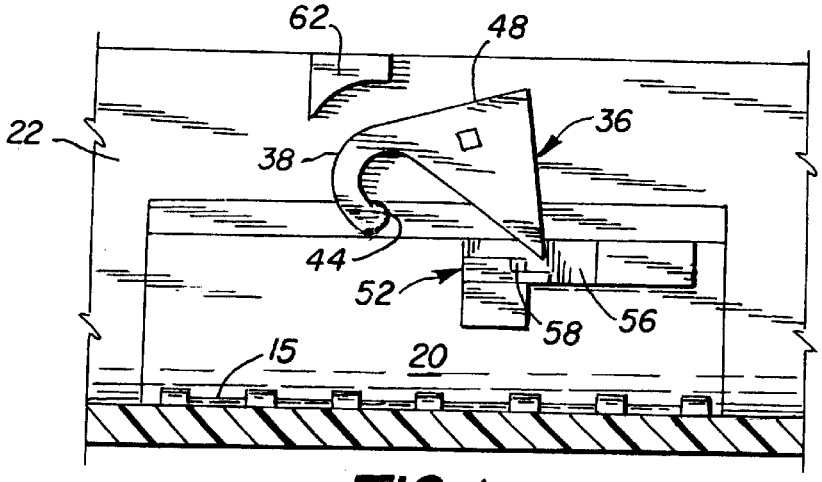
FIG. 4 is the same view as that in FIG. 3 but showing the door being pushed open by contact of the dog-ear element with the door extension.
Figure 7:
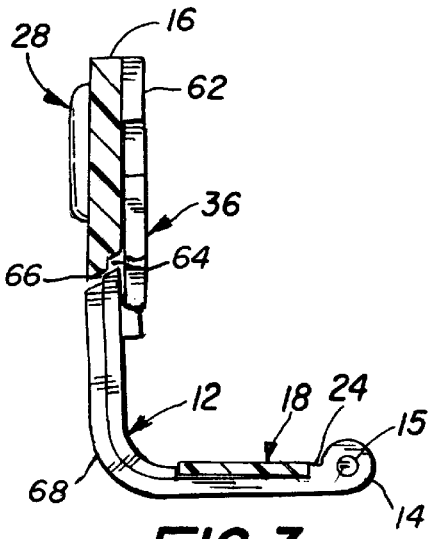
FIG. 7 is the same view as FIG. 6, however the dog-ear element is rotated allowing the door to start to open.
Figure 8:
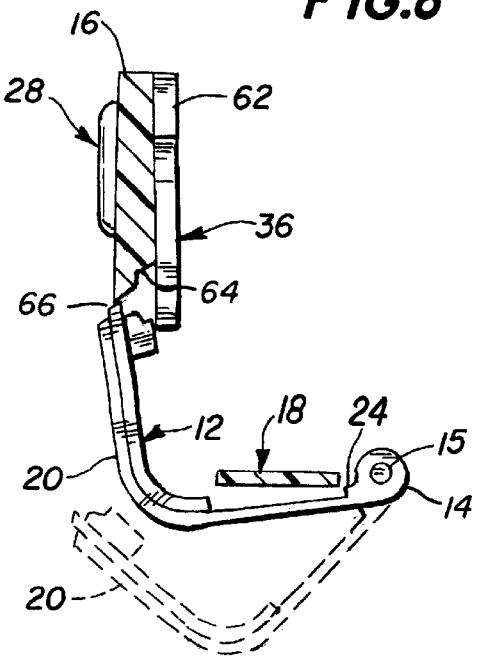
FIG. 8 shows the same view as FIG. 6 and 7 with the door in various stages of opening.

To open the corner door 12, the knob 30 is counter-rotated so that the door disengaging portion 46 urges against the ledge surface 54 thereby pushing the door 12 partially open. As the knob 30 is further counter-rotated the door disengaging portion 46 contacts the relatively long sloped surface 56, which further opens the door, as shown in FIG. 4. Still further counter-rotation causes contact with the relatively short sloped surface 58 which causes the door to open even more. The ledge surface 54 is preferably planer and substantially orthogonal to the latching portion of the corner door. The relatively long sloped surface 56 is preferably planer and at an angle in a range from about 40° to 50° from the plane of the latching portion of the corner door 12. FIGS. 6–8 illustrate the sequence of the door 12 opening.

Referring again to FIG. 7, there is a slight offset or detent 64 in the housing 16. When the door 12 is fully closed a ridge or protrusion 66 on the door 12 goes into it. As the door is forced open by the dog-ear element 36, tension forms by the bending of the plastic in the curved portion 68 of the door 12. When the ridge 66 is forced past the offset 64, the stored tension at the curved portion 68 is suddenly released, enhancing the ability for the door 12 to snap open.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A door and latch assembly for a housing, comprising:

a) an integral corner door having a hinging portion hingedly for connection to a first surface of the housing and a latching portion perpendicular to said hinging portion connectable to a second surface of the housing; and b) a latch assembly, comprising:

i) an actuatable element having a manipulative portion and a rotatable shaft affixed thereto, said manipulative portion for positioning on the second surface of the housing, said shaft for extending through an opening through said second surface;

ii) a dog-ear element securely affixed to said shaft, said dog-ear element having a first hooked end and a second end, said first hooked end forming a recess, said first hooked end having a terminal cam portion, said second end comprising a door disengaging portion;

iii) a cam receiving element located on said latching portion of said corner door which receives said terminal cam portion of said dog-ear element when said shaft has been rotated sufficiently, thus securing said corner door in a latched position; and iv) a door extension located on said latching portion of said corner door which is biased outwardly by said door disengaging portion when said shaft has been counter-rotated, thus pushing said corner door open, wherein said door extension rotates said dog-ear element away from said corner door when the door is closed as preparatory to locking it, thereby obviating the need to manually rotate the shaft in order to close the door and thus avoiding potential damage to said dog-ear element, and wherein the second end of said dog-ear element further comprises a stop engaging portion and wherein said latch assembly, further comprises a stop located on said housing, so positioned and arranged relative to said stop engaging portion of said dog-ear element as to prevent over rotation of said user actuatable element beyond said latched position.

2. The assembly of claim 1, wherein said door extension comprises a first sloped surface, said first sloped surface being sloped relative to a plane of said latching portion so that when the door is being closed said door disengaging portion of said dog-ear element is urged against said first sloped surface providing said rotation of said dog-ear element as preparatory to locking it.

3. The apparatus of claim 2, wherein said first sloped surface is planer and at an angle in a range of from about 40°–50° from the plane of the latching portion of said corner door.

4. The apparatus of claim 3, wherein said first sloped surface is at an angle of about 45° from the plane of the latching portion of said corner door.

5. The apparatus of claim 1, wherein said door extension further comprises:

a ledge surface being constructed so that when the shaft is being counter-rotated, said door disengaging portion of said dog-ear element urges against said ledge surface thereby pushing said door partially open.

6. The assembly of claim 5, wherein said door extension further comprises a relatively long sloped surface depending from said ledge surface for further opening said door upon further counter rotation of said shaft.

7. The assembly of claim 6, wherein said ledge surface is planer and substantially orthogonal to the latching portion of said corner door.

8. The assembly of claim 7, wherein said relatively long sloped surface is planer and at an angle in a range of from about 40°–50° from the plane of the latching portion of said corner door.

9. The assembly of claim 8, wherein said relatively long sloped surface is at an angle of about 45° from the plane of the latching portion of said corner door.

10. The assembly of claim 6, further including a relatively short sloped surface depending from said relatively long sloped surface and being sloped relative to both said relatively long sloped surface and the latching portion of said corner door so that when the door is being closed said door disengaging portion of said dog-ear element is urged against said relatively short sloped surface providing said rotation of said dog-ear element as preparatory to locking it.

11. The assembly of claim 10, wherein said relatively short sloped surface is planer and at an angle in a range of from about 40°–50° from the plane of the latching portion of said corner door.

12. The assembly of claim 11, wherein said relatively short sloped surface is at an angle of about 45° from the plane of the latching portion of said corner door.

13. The assembly of claim 1, wherein said door disengaging portion of said dog-ear element is pointed.

* * * * *